US009193188B2

(12) United States Patent
Aruga et al.

(10) Patent No.: US 9,193,188 B2
(45) Date of Patent: Nov. 24, 2015

(54) PRINTER

(71) Applicant: Seiko Epson Corporation, Tokyo (JP)

(72) Inventors: Yuichi Aruga, Nagano-ken (JP); Ryuji Moriyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/227,787

(22) Filed: Mar. 27, 2014

(65) Prior Publication Data

US 2014/0292926 A1 Oct. 2, 2014

(30) Foreign Application Priority Data

Mar. 27, 2013 (JP) ..... 2013-065782
Mar. 27, 2013 (JP) ..... 2013-065786
Mar. 27, 2013 (JP) ..... 2013-065787

(51) Int. Cl.
*B41J 11/20* (2006.01)
*B41J 25/308* (2006.01)

(52) U.S. Cl.
CPC ..... *B41J 11/20* (2013.01); *B41J 25/308* (2013.01); *B41J 25/3082* (2013.01); *B41J 25/3088* (2013.01)

(58) Field of Classification Search
CPC ... B41J 25/308; B41J 25/3082; B41J 25/3088
See application file for complete search history.

(56) References Cited

U.S. PATENT DOCUMENTS

| | | | | |
|---|---|---|---|---|
| 6,068,374 | A | 5/2000 | Kurata et al. | |
| 2005/0253880 | A1 | 11/2005 | Nakamura et al. | |
| 2006/0193670 | A1* | 8/2006 | Fukumasu et al. | 400/144.2 |
| 2007/0195154 | A1 | 8/2007 | Nishitani | |
| 2014/0292847 | A1* | 10/2014 | Aruga et al. | 347/8 |

FOREIGN PATENT DOCUMENTS

| | | | |
|---|---|---|---|
| JP | 07-214766 | A | 8/1995 |
| JP | 2001-146002 | A | 5/2001 |
| JP | 2005-280206 | A | 10/2005 |
| JP | 2005-280209 | A | 10/2005 |
| JP | 2007-245704 | A | 9/2007 |

* cited by examiner

*Primary Examiner* — Justin Seo

(57) ABSTRACT

The platen gap adjustment mechanism 70 of a printer 1 adjusts a gap between a printhead 59 and a platen 25 by moving first and second guide rails 57, 58 that support the head carriage 59 in a gap adjustment direction relative to the platen 25. A rotary mechanism for synchronously rotating the first and second guide rails 57, 58 to adjust the gap has a rotary shaft 101 perpendicular to the first and second guide rails 57, 58; first and second drive-side gears (e.g. worms) 104, 105 disposed coaxially to the rotary shaft 101; a first driven-side gear (e.g. worm wheel) 106 disposed coaxially to the first guide rail 57 and meshing with the first drive-side gear 104; and a second driven-side gear (e.g. worm wheel) 107 disposed coaxially to the second guide rail 58 and meshing with the second drive-side gear 105.

15 Claims, 10 Drawing Sheets

PRINTER

CROSS-REFERENCE TO RELATED APPLICATIONS

The present application claims priority based on and incorporates by reference the entire contents of Japanese Patent Application No. 2013-065782 filed on Mar. 27, 2013, Japanese Patent Application No. 2013-065786 filed on Mar. 27, 2013, and Japanese Patent Application No. 2013-065787 filed on Mar. 27, 2013.

BACKGROUND

1. Technical Field

The present invention relates to a printer having a platen gap adjustment mechanism to adjust a gap between a printhead and a platen.

2. Related Art

Printers such as inkjet printers commonly have a platen gap adjustment mechanism to adjust a gap between a nozzle face of an inkjet head and a platen, or a gap between the nozzle face and a printing surface of a print medium conveyed over the platen. The platen gap adjustment mechanism adjusts the gap between the nozzle face and the platen, or the gap between the nozzle face and the printing surface of the print medium, in response to a control signal from a host device or a control unit inside the printer based on specifications of the print medium (such as its thickness and surface condition) and the state of the printer (such as errors).

JP-A-2005-280206 and JP-A-2005-280209 disclose printers having this type of platen gap adjustment mechanism. In the printers disclosed in these patent documents, a carriage carrying a printhead is supported by two carriage guide rails. The two carriage guide rails are attached to an elevator frame. The elevator frame is attached to move vertically on printer side frames located on opposite ends of the carriage guide rails.

The platen gap adjustment mechanism transfers rotation of an elevator motor attached to the printer frame through a geared transfer mechanism to one of the carriage guide rails. Rotation transferred to the carriage guide rail is then transferred through a gear train of multiple spur gears on the elevator frame to the other carriage guide rail. At the end of each carriage guide rail is a cam mechanism that changes rotational movement of the carriage guide rails to vertical movement of the carriage guide rails. The carriage guide rails move vertically in a synchronous manner by means of a rotary cam conversion mechanism. When the carriage guide rails synchronously move vertically, the gap between the recording head on the carriage and the platen on the stationary side changes.

JP-A-2005-280206 describes a mechanism for transferring rotation from one carriage guide rail to the other carriage guide rail. The mechanism uses a timing belt mounted on the two carriage guide rails in addition to a gear train of plural spur gears, and a connecting rod between rotary disks attached to the ends of the two carriage guide rails.

Although effective, platen gap adjustment mechanisms according to the related art still have issues that require resolution. For example, six issues related to prior art platen gap adjustment mechanisms that need to be resolved are described below.

First, a synchronous rotary mechanism that connects and synchronously turns two carriage guide rails through a gear train of spur gears requires plural spur gears between the two carriage guide rails. The number of gears in the synchronous rotary mechanism increases as the distance between the rails increases, and the size of the elevator frame to which these parts are disposed also increases. Furthermore, because rotation of the elevator motor shaft must be transferred through a speed reducer, more spur gears are required to achieve the desired speed reduction. The space required to install the synchronous rotary mechanism therefore further increases.

Because space for locating the timing belt connecting the two rails must also be provided in a mechanism that uses a timing belt, the required installation space increases further when the gap between the rails is large. A mechanism having a connecting rod between rotating disks disposed to two rails likewise requires sufficient space for the connecting rods to move in conjunction with the rotating disks, and the required installation space increases accordingly.

Second, because there is backlash between the meshing teeth in a synchronous rotary mechanism using spur gears, both carriage guide rails cannot be synchronously driven with good precision due to backlash when transferring rotation starts and when the direction of rotation changes. If both carriage guide rails do not turn synchronously, variation can also occur in how far the carriage guide rails move vertically in conjunction with rail rotation. The platen gap can therefore differ between the one carriage guide rail and the other carriage guide rail.

Various problems can also arise in a mechanism using a timing belt due to backlash between the teeth of the timing belt and the gears on which the timing belt is mounted. Problems can also result in a mechanism connecting rotating disks with connecting rods due to backlash in the coupling between the rotating disk and the connecting rod.

To avoid such backlash in the synchronous drive mechanism, play (a dead zone) of specific size must be provided in the cam mechanism that converts shaft rotation to vertical movement of each shaft. This configuration can move the rails vertically and adjust the platen gap with good precision after eliminating backlash between the gears and starting synchronous rotation in the synchronous rotary mechanism when the rails start turning and when the rails change direction. However, providing a specific play in the rotary cam increases the diameter of the rotary cam and increases the space occupied by the cam mechanism.

Third, in the platen gap adjustment mechanism according to the related art, rotation of the shaft of the stationary elevator motor attached to the printer frame is transferred through a geared transfer mechanism to a carriage guide rail on the elevator mechanism side. The spur gear on the stationary side and the spur gear on the elevator side remained meshed in this geared transfer mechanism. Because the gears on the stationary and elevator sides must remain meshed, vertical movement of the gears on the elevator side cannot be increased. Increasing adjustment of the platen gap is therefore difficult.

Fourth, a geared transfer mechanism comprises plural spur gears that rotate on an axis parallel to the axis of the carriage guide rail. When torque from the stationary elevator motor is transferred to the gear fixed coaxially to the carriage guide rail, force is applied to this gear in the direction of rotation from the drive-side gear. Force therefore works in the direction causing the carriage guide rail to move vertically. To prevent this force from causing the carriage guide rail to move vertically, a spring member that can produce a strong spring force must be provided to prevent the carriage guide rail from moving. Because a strong spring force is thus applied, the durability of the gears and parts supporting the carriage guide rails decreases, and space for accommodating a large spring member is required.

Fifth, with the platen gap adjustment mechanism according to the related art, rotation of the stationary elevator motor affixed to the printer frame is transferred through a geared transfer mechanism composed of spur gears to the carriage guide rails on the elevator side (moving side). With a geared transfer mechanism, spur gears on the stationary side and spur gears on the moving side must be kept meshed. Because the gears on the stationary and moving sides cannot disengage, the spur gears on the moving side cannot move very much up and down. Increasing the platen gap adjustment distance is therefore difficult. The gears on the rotating side and the gears on the elevator side also cannot be offset in the direction of the gear width (along the axis of rotation). Parts on the stationary drive source side, and parts on the vertically moving side can therefore not be offset greatly in the tooth width direction, and the layout is therefore limited.

Sixth, conveyance rollers for conveying the print medium past the platen are disposed in the printer on the upstream and downstream sides of the platen in the conveyance direction. The conveyance rollers are disposed across the width of the print medium conveyance path between the printer side frames. Parts of the media conveyance power transfer mechanism that transfers rotation to the conveyance rollers are disposed on the outside of one side frame of the printer. Providing space for the platen gap adjustment mechanism on the same printer side frame as the power transfer mechanism is therefore difficult. The platen gap adjustment mechanism must therefore be disposed to the printer side frame on the opposite side of the printer, and freedom in locating the platen gap adjustment mechanism is therefore limited.

SUMMARY

A printer with a platen gap adjustment mechanism according to the invention has a synchronous rotary mechanism having few parts and requiring little space.

A printer with a platen gap adjustment mechanism having a synchronous rotary mechanism according to the invention can also synchronously rotate two carriage guide rails with good precision.

A printer with a platen gap adjustment mechanism according to the invention also enables a large gap adjustment.

A printer with a platen gap adjustment mechanism having a synchronous rotary mechanism according to the invention also does not produce force in the gap adjustment direction.

A printer with a platen gap adjustment mechanism according to the invention also has a high degree of freedom in the layout of parts on the stationary side and parts on the moving side.

A printer according to the invention also enables disposing the platen gap adjustment mechanism to a printer side frame on either side of the print medium conveyance path whether or not the media conveyance power transfer mechanism is on the same side.

The present invention is directed to solving at least part of the foregoing problems, and can be achieved by the embodiments or examples described below.

EXAMPLE 1

A printer according to the present invention includes a printhead; a head carriage carrying the printhead; a first guide rail and a second guide rail that are mutually parallel and support the head carriage; a platen opposite the printhead; and a platen gap adjustment mechanism that adjusts a gap between the printhead and the platen by moving the first and second guide rails along a gap adjustment direction to approach or recede from the platen, said platen gap adjustment mechanism having a rotary mechanism that synchronously drives the first guide rail and the second guide rail in synchronous rotation, wherein the moving of the first and second guide rails along the gap adjustment direction is dependent upon the synchronous rotation of the first and second guide rails; the rotary mechanism including: a rotary shaft extending perpendicularly to the first guide rail and the second guide rail, a first drive-side gear and a second drive-side gear coaxially attached to the rotary shaft, a first driven-side gear coaxially attached to the first guide rail and meshing with the first drive-side gear, and a second driven-side gear coaxially attached to the second guide rail and meshing with the second drive-side gear.

EXAMPLE 2

In a printer according to another aspect of the invention, the first drive-side gear and the second drive-side gear are preferably worms, and the first driven-side gear and the second driven-side gear are worm wheels.

In the synchronous rotary mechanism in this configuration, the first and second drive-side gears are disposed to rotary shafts disposed perpendicularly to the first and second guide rails. More specifically, the first and second drive-side gears are fixed coaxially to the rotary shafts, or are formed coaxially in unison with the rotary shafts. Rotation of the rotary shafts is transferred from the first and second drive-side gears to the first and second driven-side gears on the first and second guide rail side. When the distance between the first and second guide rails is great, the length of the rotary shafts can be simply increased, and there is no need to increase the number of gears. The synchronous rotary mechanism of the invention can therefore be configured using fewer parts and occupies less space than a synchronous rotary mechanism according to the related art such as a synchronous rotary mechanism composed of numerous spur gears.

Because the first and second drive-side gears are disposed on the same rotary shaft, they rotate in perfect synchronization in unison with the rotary shaft. Because the first and second drive-side gears mesh with first and second driven-side gears on perpendicular axes of rotation, there is less backlash than in a configuration in which spur gears mesh on parallel axes of rotation. More particularly, there is zero backlash when configured using cylindrical worm gear pairs. The first and second guide rails can therefore be synchronously rotated with good precision, and the platen gap can be precisely adjusted.

When worms are used for the first and second drive-side gears and worm wheels are used for the first and second driven-side gears, a specified speed reduction ratio can be achieved using fewer gears than a configuration made of spur gears. The platen gap adjustment mechanism can therefore be built small and compact.

The first drive-side gear and the first driven-side gear mesh with their axes of rotation perpendicular. The second drive-side gear and the second driven-side gear also mesh with their axes of rotation perpendicular. The gears can mesh in this way if the first drive-side gear and the second drive-side gear are worms, and the first driven-side gear and the second driven-side gear are worm wheels. Bevel gears could also be used instead of cylindrical worm gears.

The first and second drive-side gears and the first and second driven-side gears mesh on perpendicular axes of rotation. Force causing the driven-side gear to move in the direction of rotation is not applied from the drive-side gears to the driven-side gears. Force moving the guide rails on which the driven-side gears are mounted to move the gap adjustment direction is not applied. Unlike a geared transfer mechanism composed of meshing spur gears, strong force in the gap adjustment direction does therefore not work on the guide rails, and there is no need for a strong spring force to hold the guide rails so they do not move in the gap adjustment direction.

EXAMPLE 3

In a printer according to another aspect of the invention, the platen gap adjustment mechanism further includes: a first cam mechanism that converts rotation of the first guide rail to movement of the first guide rail along the gap adjustment direction, and a second cam mechanism that converts rotation of the second guide rail to movement of the second guide rail along the gap adjustment direction, the first and second cam mechanisms being identically configured cam mechanisms, wherein: the first cam mechanism includes a first rotary cam coaxially attached to the first guide rail and having a first outside cam surface, and the second cam mechanism includes a second rotary cam coaxially attached to the second guide rail and having a second outside cam surface; a first cam follower disposed in a first fixed position along the gap adjustment direction and having a sliding contact point with the first outside cam surface, wherein the shape of the first outside cam surface causes the contact point of the first outside cam surface and the first cam follower to move along the gap adjustment direction with rotation of the first rotary cam; and a second cam follower disposed in a second fixed position along the gap adjustment direction and having a sliding contact point with the second outside cam surface, wherein the shape of the second outside cam surface causes the contact point of the second outside cam surface and the second cam follower to move along the gap adjustment direction with rotation of the second rotary cam.

As described above, the first and second guide rails precisely rotate synchronously in the platen gap adjustment mechanism with this configuration. There is therefore no need for play in the rotary cam mechanism that converts rotation of the first and second guide rails to movement of the rails in the gap adjustment direction in order to absorb variation in the synchronous rotation of the two guide rails. Because a rotary cam with a small diameter can therefore be used, the size of the platen gap adjustment mechanism can also be reduced. The platen gap can therefore be adjusted in a short time with good precision.

EXAMPLE 4

Further preferably in the platen gap adjustment mechanism in a printer according to another aspect of the invention, the parallel first and second guide rails have respective first ends along a first longitudinal direction, and respective second ends along a second longitudinal direction opposite the first longitudinal direction; the first driven-side gear is fixed to the first end of the first guide rail; the second driven-side gear is fixed to the second end of the second guide rail; the first cam mechanism includes two of said first rotary cams, one disposed at the first end of the first guide rail and the other disposed at the second end of the first guide rail; and the second cam mechanism includes two of said second rotary cams, one disposed at the first end of the second guide rail and the other disposed at the second end of the second guide rail.

In this configuration, the first and second guide rails are moved at both ends of the rails in the gap adjustment direction synchronously to rotation by the first and second cam mechanisms. The platen gap can therefore also be precisely adjusted with no variation in the axial direction of the first and second guide rails.

EXAMPLE 5

Further preferably, the platen gap adjustment mechanism of the invention includes: a rotational drive source disposed at a fixed position along the gap adjustment direction; a stationary-side rotary shaft rotationally driven by the rotational drive source; and a universal coupling that connects the stationary-side rotary shaft to the rotary shaft of the rotary mechanism of the platen gap adjustment mechanism.

With this configuration, the rotational drive source and drive-side rotary shaft are generally disposed to a fixed position in the gap adjustment direction, and the rotary shaft on the first and second guide rail side moves in the gap adjustment direction together with the first and second guide rails. The drive-side rotary shaft on the stationary side, and the rotary shaft on the movable side are connected through a universal coupling. Torque is therefore transferred from the drive-side rotary shaft to the rotary shaft on the movable side even if the rotary shaft on the movable side moves in the gap adjustment direction. Movement of the rotary shaft on the movable side in the gap adjustment direction can therefore be increased more easily than in a configuration that moves a spur gear on the movable side relative to a spur gear on the drive side while keeping the spur gears meshed. A platen gap adjustment mechanism enabling a large platen gap adjustment can therefore be easily achieved.

EXAMPLE 6

A printer according to another aspect of the invention has: a printhead; a platen opposite the printhead; and a platen gap adjustment mechanism that adjusts a gap between the printhead and the platen, a direction along which the gap increases or decreases being a gap adjustment direction, said platen gap adjustment mechanism including: a movable part defined by a first assembly that can be displaced along the gap adjustment direction, said first assembly including a movable-side rotary shaft, a stationary part defined by a second assembly that is stationary and disposed at a fixed position along the gap adjustment direction, said second assembly including a stationary-side rotary shaft, and a universal joint unit connecting the stationary-side rotary shaft to the movable-side rotary shaft; wherein the printhead is disposed to the movable part, and the platen is disposed at a fixed position.

With this configuration, the movable part that moves when the gap is adjusted remains connected to the stationary part through the universal joint unit. Torque is transferred from the stationary-side rotary shaft to the movable-side rotary shaft even if the movable-side rotary shaft moves in the gap adjustment direction. The universal joint enables greater movement of the movable-side rotary shaft than a rotary transfer mechanism composed of meshed spur gears. A platen gap adjustment mechanism enabling a large gap adjustment can therefore be achieved.

The universal joint enables movement of the movable part in the gap adjustment direction and a direction perpendicular to the gap adjustment direction. There is therefore greater freedom in the layout of the stationary part and the movable part.

EXAMPLE 7

In a printer according to another aspect of the invention, the universal joint unit includes a stationary-side universal joint part coupled to the stationary-side rotary shaft, and a movable-side universal joint part coupled to the movable-side rotary shaft.

This configuration enables movement of the movable-side rotary shaft in a direction perpendicular to the axis of rotation without a change in orientation.

EXAMPLE 8

A printer according to another aspect of the invention also preferably has a head carriage on which the printhead is mounted, and a guide rail that supports the head carriage slidably in a direction perpendicular to the gap adjustment direction, the guide rail being mounted to the movable part.

This configuration enables moving the printhead in the gap adjustment direction relative to the platen.

EXAMPLE 9

In a printer according to another aspect of the invention, the platen gap adjustment mechanism includes a rotary transfer mechanism that transfers rotation of the movable-side rotary shaft to rotation of the guide rail, and a cam mechanism that converts rotation of the guide rail to displacement movement of the movable part along the gap adjustment direction.

EXAMPLE 10

In a printer according to another aspect of the invention, the rotary transfer mechanism includes a worm disposed coaxially to the movable-side rotary shaft, and a worm wheel disposed coaxially to the guide rail and meshing with the worm.

EXAMPLE 11

In a printer according to another aspect of the invention, the cam mechanism includes a rotary cam having an outside cam surface and rotating in unison with the guide rail, and a cam follower disposed at a fixed position in the gap adjustment direction and slidably contacting the outside cam surface, wherein the outside cam surface is shaped so that the contact position of the outside cam surface and the cam follower moves along the gap adjustment direction with rotation of the rotary cam rotates.

In these configurations, the worm is mounted on the movable-side rotary shaft disposed perpendicularly to the guide rail, and rotation of the movable-side rotary shaft is transferred to the guide rail through the worm and worm wheel. The transfer mechanism can therefore be configured smaller and more compactly than a configuration that transfers torque through meshing spur gears.

Because the worm and worm wheels mesh on perpendicular axes of rotation, there is less backlash than in a configuration in which spur gears mesh on parallel axes of rotation. More particularly, there is zero backlash when configured with a worm gear pair. The platen gap can therefore be precisely adjusted because rotation of the movable-side rotary shaft can be precisely transferred to the guide rail.

Furthermore, by using a worm and worm wheel set, a higher speed reduction ratio can be achieved than a configuration made of spur gears. Because a specified speed reduction ratio can be achieved using fewer gears, the invention can be effectively used to achieve a small, compact platen gap adjustment mechanism.

The worm and worm wheel also mesh on perpendicular axes of rotation. Force causing the driven-side worm wheel to move in the direction of rotation is not applied from the drive-side worm to the driven-side worm wheel. More specifically, force moving the guide rails on which the worm wheel is mounted to move the gap adjustment direction is not applied. Unlike a geared transfer mechanism composed of meshing spur gears, strong force in the gap adjustment direction does therefore not work on the guide rails, and there is no need for a strong spring force to hold the guide rails so they do not move in the gap adjustment direction.

A cam mechanism having a rotary cam that rotates in unison with the guide rail and has an outside cam surface, and a cam follower disposed to a fixed position in the gap adjustment direction and sliding in contact with the outside cam surface, can be used as the cam mechanism that converts rotation of the guide rail to movement of the guide rail in the gap adjustment direction. In this configuration, the outside cam surface is shaped so that the contact position of the outside cam surface and the cam follower moves in the gap adjustment direction when the rotary cam rotates.

EXAMPLE 12

A printer according to another aspect of the invention has a printhead; a head carriage on which the printhead is mounted; a guide rail that supports the head carriage slidably widthwise to a print medium conveyance path; a platen disposed opposite the printhead with the print medium conveyance path therebetween; a platen gap adjustment mechanism that adjusts a gap between the printhead and the platen by moving (i.e. displacing) the guide rail in the gap adjustment direction defined as a directional path toward or away from the platen; and opposing printer side-frames disposed on opposite sides of the width of the print medium conveyance path and supporting the opposite ends of the guide rail movably in the gap adjustment direction. The platen gap adjustment mechanism includes a rotary transfer mechanism that transfers rotation to the guide rail, and a cam mechanism that converts rotation of the guide rail to displacement movement of the guide rail in the gap adjustment direction, wherein the facing surfaces of opposing printer side-frames are defined as inside surfaces, and the surface of each printer side-frame opposite its respective inside surface is defined as an outside surface. The rotary transfer mechanism and the cam mechanism are disposed to one printer side-frame on its inside frame surface.

The distance between the printer side frames on opposite sides of the print medium conveyance path is greater than necessary for movement of the head carriage in order to prevent collision with the head carriage when the head carriage moves widthwise to the media conveyance path. Dead space therefore results easily in the area between the printer side frames.

This configuration of the invention places parts of the platen gap adjustment mechanism along the inside surface of the printer side frame to solve this problem. Parts of the platen gap adjustment mechanism can therefore be placed along the inside surface of the printer side frames even if the power transfer mechanism for media conveyance that transfers rotation to the media conveyance rollers is disposed along the outside of the same printer side frame. As a result, the location of the platen gap adjustment mechanism is not limited by the location of the power transfer mechanism for media conveyance, the platen gap adjustment mechanism can be placed on either side of the print medium conveyance path, and freedom of layout is increased.

EXAMPLE 13

In a printer according to another aspect of the invention, the rotary transfer mechanism includes a rotary shaft extending along the inside frame surface perpendicularly to the guide rail, a worm disposed coaxially to the rotary shaft, and a worm wheel disposed coaxially to a first end of the guide rail and meshing with the worm; and the cam mechanism includes: a rotary cam attached to the first end of the guide rail and positioned between the worm wheel and the inside frame surface, and a cam follower disposed at a position on the inside frame surface where the cam follower continuously contacts the outside cam surface of the rotary cam at a contact point, wherein the outside cam surface is shaped so that the contact point moves along the gap adjustment direction with rotation of the rotary cam.

Configuring the rotary transfer mechanism of the platen gap adjustment mechanism with a gear train of spur gears requires numerous spur gears and a frame on which to mount the spur gears. By using worm gears, the rotary transfer mechanism according to the invention needs few parts and occupies little space. Increase in the size of the printer widthwise to the print medium conveyance path can therefore be suppressed even if the rotary transfer mechanism is disposed along the inside surface of the printer side frame.

EXAMPLE 14

A printer according to another aspect of the invention further preferably has a media conveyance roller disposed between the printer side-frames and conveying a print medium along the print medium conveyance path; and a power transfer mechanism that transfers rotation from a rotary drive source to the media conveyance roller. The rotary transfer mechanism and the cam mechanism are disposed along the inside surface of one printer side-frame, and the power transfer mechanism is disposed along the outside surface of the printer side-frame opposing the one printer side-frame.

EXAMPLE 15

In a printer according to another aspect of the invention, the rotary transfer mechanism of the platen gap adjustment mechanism includes a carriage stop configured to contact the head carriage when the head carriage moves past a specific position toward one of the printer side-frame.

By disposing parts of the platen gap adjustment mechanism along the inside of the printer side frame, this configuration enables locating the platen gap adjustment mechanism on the inside side of the printer side frame while disposing the media conveyance power transfer mechanism on the outside of the same frame member.

EXAMPLE 16

In a printer according to another aspect of the invention, the platen gap adjustment mechanism includes a stationary-side rotary shaft disposed at a fixed position along the gap adjustment direction; and a universal joint connecting the stationary-side rotary shaft to the rotary shaft.

This configuration enables disposing the stationary-side rotary shaft and the rotary shaft at mutually offset positions in a direction perpendicular to their axes of rotation. There is therefore greater freedom in the layout of parts in the platen gap adjustment mechanism on the side that moves with the guide rail in the gap adjustment direction relative to the parts on the stationary side.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. The following exemplary embodiment describes the invention as applied in an inkjet printer with a reversing unit enabling two-sided printing. It is to be understood that the invention can also be used in an inkjet printer that does not have a reversing unit, and in printers other than inkjet printers.

General Configuration of a Printer

Figure 1:
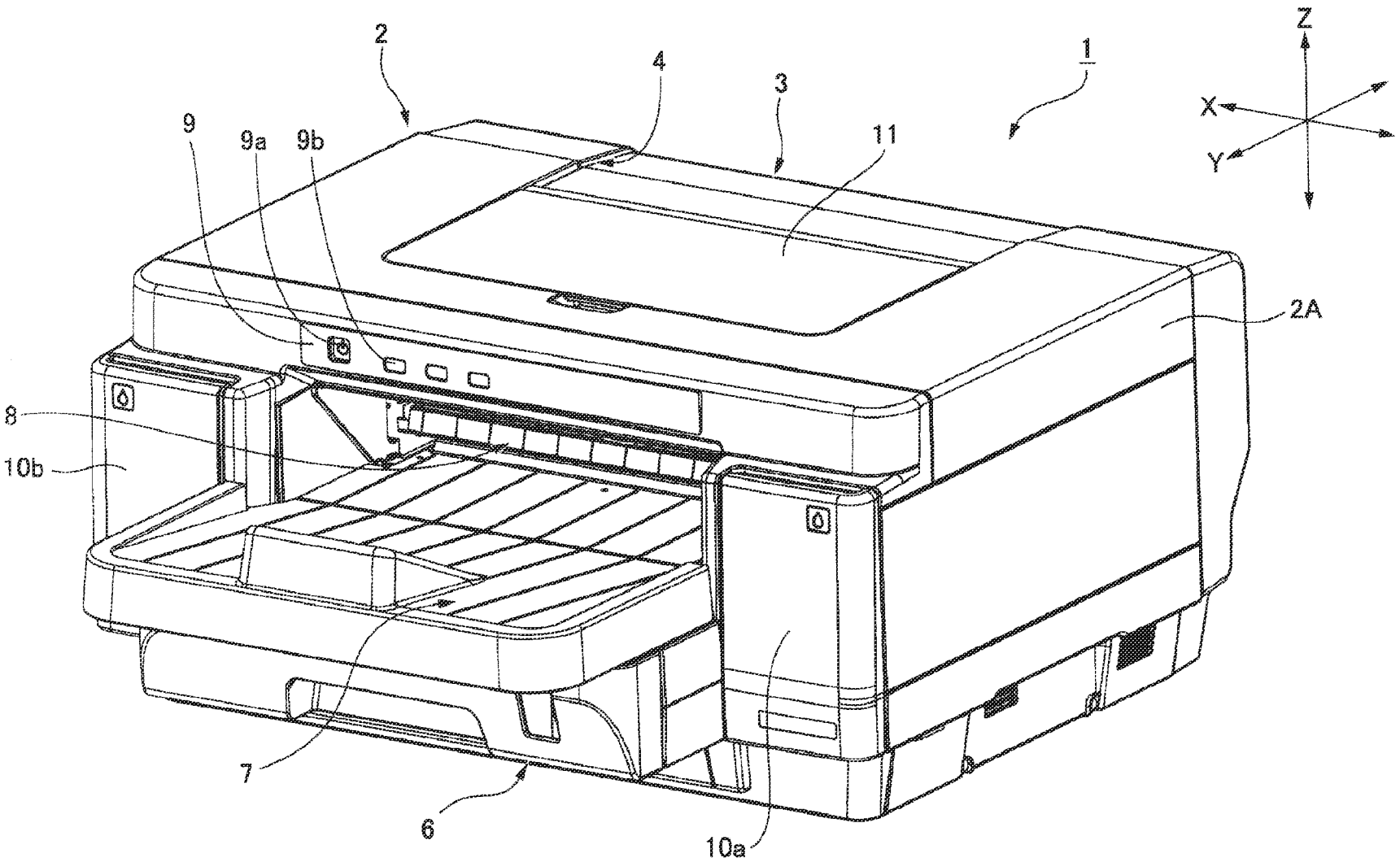
FIG. 1 is an oblique front view of a printer according to the invention.
Figure 2:
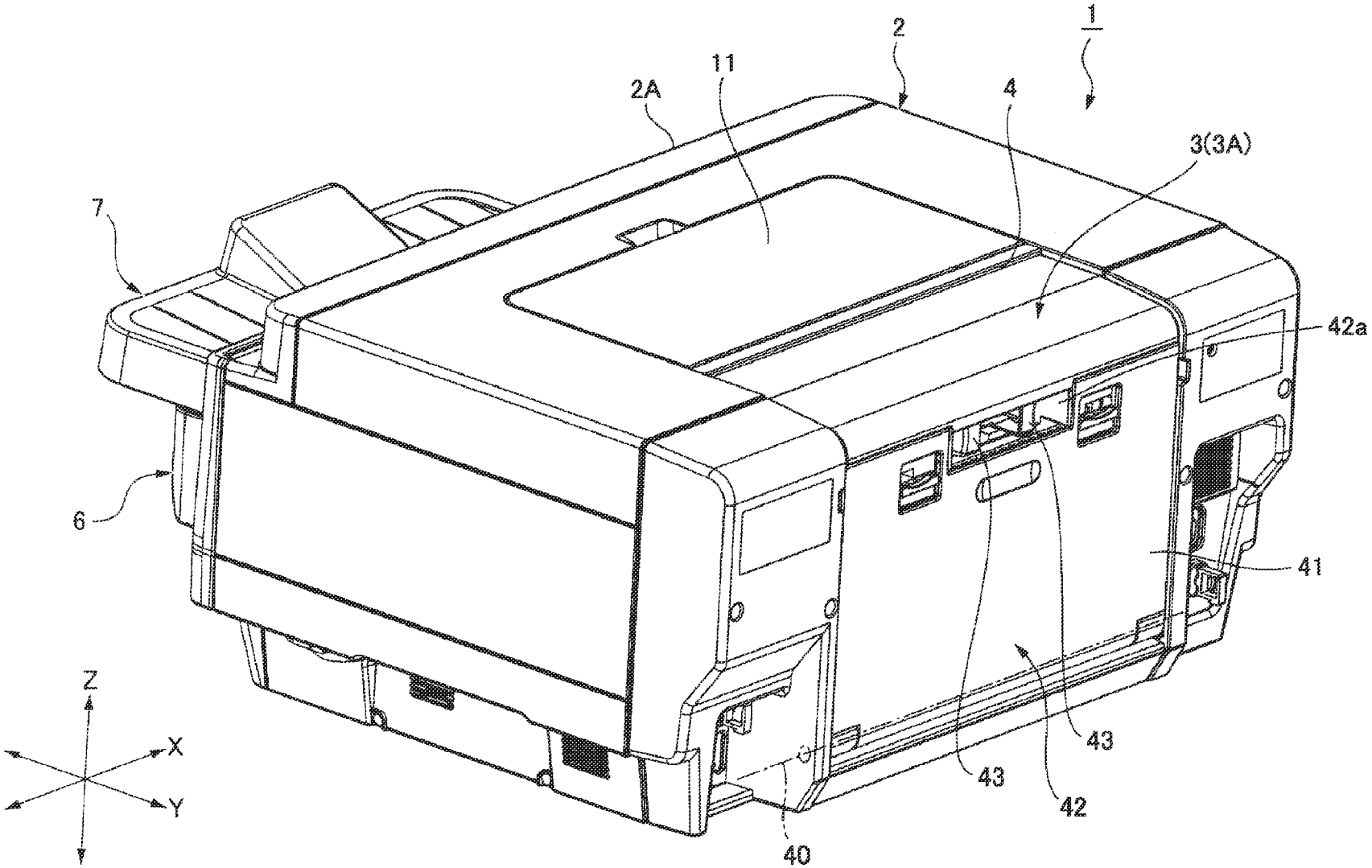
FIG. 2 is an oblique rear view of the printer shown in FIG. 1.
Figure 3:
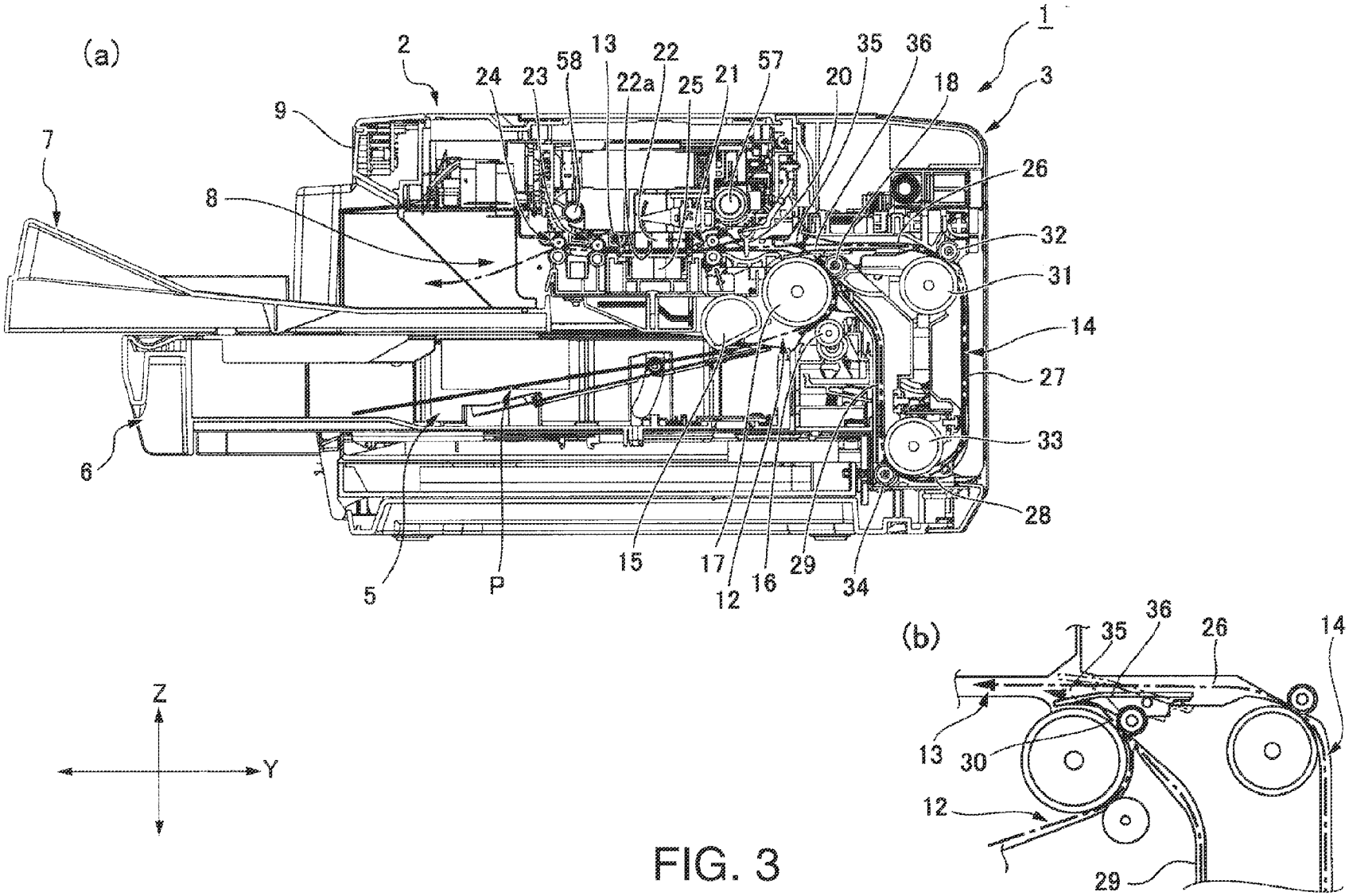
FIG. 3 is a vertical section view and a partial section view of the printer shown in FIG. 1.

FIG. 1 is an external oblique view from the front of an inkjet printer ("printer" below) 1 according to this embodiment of the invention, and FIG. 2 is an external oblique view of the printer 1 from the back. FIG. 3 (*a*) is a vertical section view and FIG. 3 (*b*) is a partial section view of the internal configuration of the printer.

The general configuration of the printer 1 is described referring primarily to FIG. 1 and FIG. 2. The printer 1 has a printer cabinet 2 and a reversing unit 3. The printer cabinet 2 includes a main case 2A with a basically rectangular box-like shape that is long on the transverse axis X widthwise to the printer, and having a recess 4 in the middle of the back where the reversing unit 3 is installed. The reversing unit 3 is a unit for reversing the front and back sides of the printing paper ("paper" below), which is a form of sheet media, and then returning the reversed paper into the printer cabinet 2. The reversing unit 3 is a reversing unit that can open and close as further described below, and can pivot on the bottom part on the vertical axis Z of the printer to open to the back of the printer on the longitudinal axis Y.

A paper cassette loading unit 5 (shown in FIG. 3) is disposed to the front of the printer cabinet 2. The paper cassette loading unit opens to the front on the longitudinal axis Y at a position toward the bottom on the vertical axis Z in the front of the printer cabinet 2. A paper cassette 6 can be loaded from the front into the paper cassette loading unit 5. A paper discharge tray 7 is attached at the top of the paper cassette loading unit 5. The paper discharge tray 7 extends substantially horizontally to the front. A rectangular paper exit 8 extending toward the back of the printer is formed at the top of the paper discharge tray 7.

An operating panel 9 is at the front of the printer above the paper exit 8. The operating panel 9 includes a power switch 9*a* and a plurality of state indicators 9*b*. Rectangular access doors 10*a*, 10*b* are attached to the front of the printer on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is flat, and has an access cover 11 attached in the middle for maintenance.

Paper Conveyance Path of the Printer

The internal configuration of the printer 1, and particularly the paper conveyance path, is described next with reference to FIG. 3. A paper supply path 12, main conveyance path 13, and reversing conveyance path 14 are formed inside the printer 1. The paper supply path 12 and main conveyance path 13 are formed inside the printer cabinet 2, and the reversing conveyance path 14 is formed inside the reversing unit 3.

The paper supply path 12 is a conveyance path that conveys paper P of a specific size stored in a stack in the paper cassette 6 to the main conveyance path 13. The paper supply path 12 extends diagonally up from the back end of the paper cassette loading unit 5 on the longitudinal axis Y, curves toward the front, and connects to the main conveyance path 13. Paper P stored in the paper cassette 6 is fed by a paper feed roller 15 to the paper supply path 12. The supplied paper is fed one sheet at a time through the nipping part of a conveyance roller 17 and a retard roller 16, which is a media separation roller. The paper P conveyed through the nipping part of the retard roller 16 and conveyance roller 17 is conveyed through the nipping part of the conveyance roller 17 and a follower roller 18 to the main conveyance path 13.

The main conveyance path 13 is the conveyance path extending substantially horizontally along the longitudinal axis Y to the paper exit 8. Disposed along the main conveyance path 13 from the upstream side in the paper conveyance direction are a paper detection lever 20, a paper feed roller pair 21, a printhead 22, a first discharge roller pair 23, and a second discharge roller pair 24. The printhead 22 is an inkjet head, and a platen 25 is disposed opposite the nozzle face with a specific gap therebetween.

Paper fed from the paper supply path 12 to the main conveyance path 13 is conveyed by the conveyance roller 17 to the paper feed roller pair 21 while pushing up on the paper detection lever 20. The paper fed into the paper feed roller pair 21 is conveyed past the printing position of the printhead 22 by the paper feed roller pair 21 toward the first discharge roller pair 23. The paper fed to the first discharge roller pair 23 passes the first discharge roller pair 23 and second discharge roller pair 24, and is discharged from the paper exit 8 onto the paper discharge tray 7.

The reversing conveyance path 14 formed inside the reversing unit 3 is located below the main conveyance path 13 on the vertical axis Z, and is a conveyance path that generally forms a loop. The reversing conveyance path 14 includes an upstream path 26 that connects to the upstream end of the main conveyance path 13 and extends substantially horizontally to the back on the longitudinal axis Y, a descending path 27 that curves and extends down in a straight line on the vertical axis Z from the upstream path 26, a bottom path 28 that connects to the descending path 27 and curves to the front on the longitudinal axis Y, and an ascending path 29 that curves and extends upward from the bottom path 28.

The top part of the ascending path 29 curves at an angle to the printer front, and merges with the paper supply path 12 in the middle. More specifically, ascending path 29 and the downstream part of the paper supply path 12 form a common path 30. This common path 30 is a curved path extending along the outside of the conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper conveyed from the main conveyance path 13 to the reversing conveyance path 14 is nipped by the first conveyance roller 31 and follower roller 32, then conveyed by the first conveyance roller 31 to the nipping part of the second conveyance roller 33 and follower roller 34, and then conveyed by the second conveyance roller 33 to the nipping part of the conveyance roller 17 and follower roller 18. The paper is then fed by the conveyance roller 17 to the main conveyance path 13 again.

By passing through the loop of this reversing conveyance path 14, the paper is reversed front and back and returned to the main conveyance path 13. Printing on both sides of the paper is therefore enabled by conveying the paper through the reversing conveyance path 14.

A path-changing flapper 36 is disposed at the junction 35 of the upstream end of the main conveyance path 13, the upstream end of the reversing conveyance path 14, and the downstream end of the common path 30. The path-changing flapper 36 can pivot up and down on the vertical axis Z at the back end of the flapper 36 on the longitudinal axis Y. The path-changing flapper 36 is normally held by its own weight in a first position with the main part of the flat at the front on the longitudinal axis Y resting on the outside of the conveyance roller 17.

Paper reversed from the main conveyance path 13 side in this position is guided by the path-changing flapper 36 to the reversing conveyance path 14 side. The paper then passes through the reversing conveyance path 14 and returns to the junction 35. The path-changing flapper 36 is pushed up by the paper returned to the junction 35, and can move from the first position to a second position. When the path-changing flapper 36 is pushed up to the second position, the common path 30 at the downstream end of the reversing conveyance path 14 communicates with the main conveyance path 13. The paper is therefore conveyed to the main conveyance path 13 while pushing the path-changing flapper 36 up. After the paper has past, the path-changing flapper 36 returns by its own weight to the first position.

The path-changing flapper 36 is also pushed up by the paper fed from the paper supply path 12 to the main conveyance path 13 when paper is supplied from the paper cassette 6. After the paper passes, the path-changing flapper 36 returns by its own weight to the first position. Paper reversed from the main conveyance path 13 will therefore not go through the common path 30 into the reversing conveyance path 14 or the paper supply path 12. The paper path can also be changed by a simple configuration without using a separate drive power source or urging member.

Openable Reversing Unit

Figure 4:
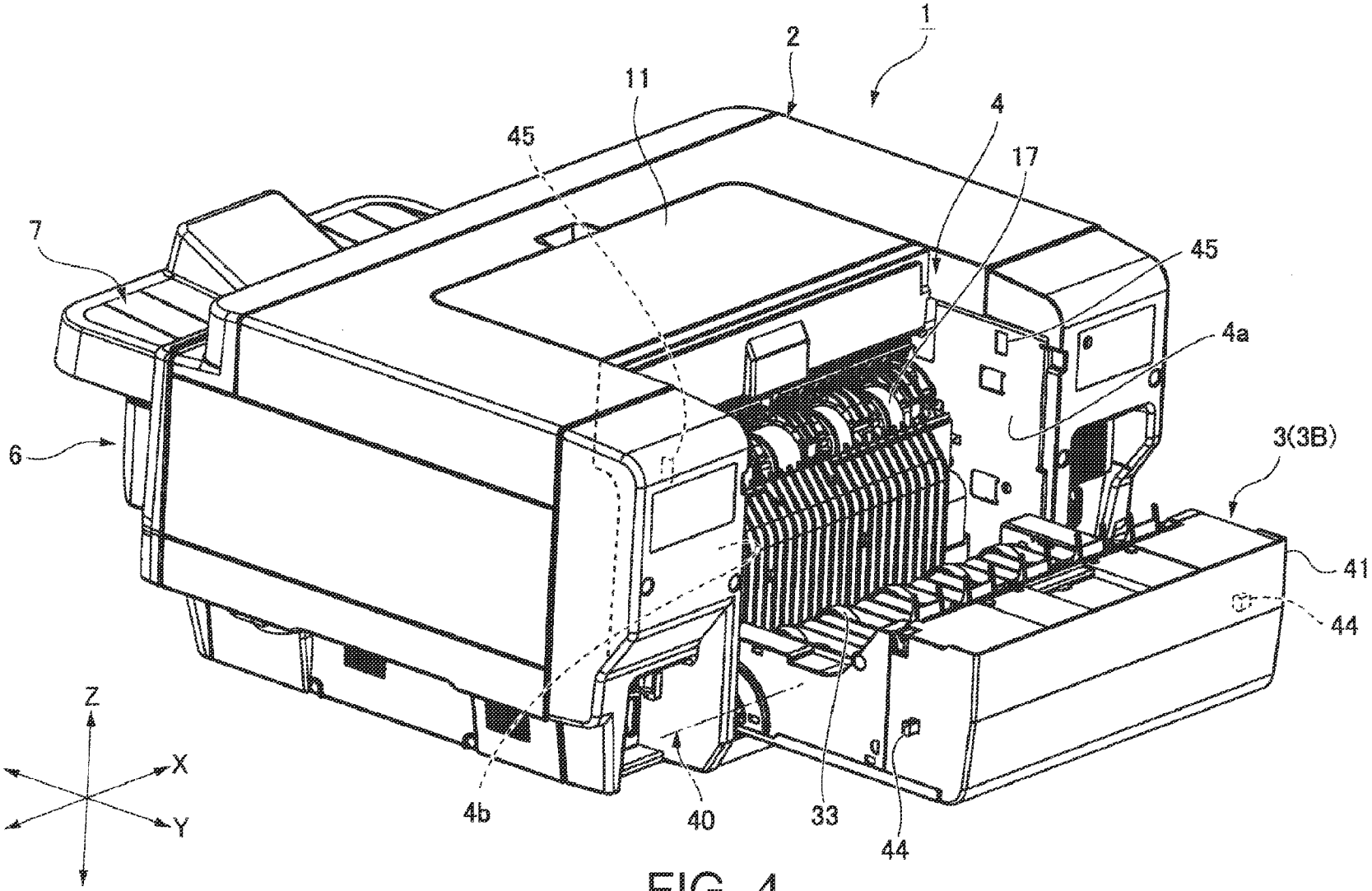
FIG. 4 is an oblique rear view of the printer shown in FIG. 1 when the reversing unit is open.

FIG. 4 is an external oblique view from the back of the printer 1 when the reversing unit 3 is open.

As will be understood from FIG. 2 and FIG. 4, the reversing unit 3 can open and close pivoting on a pivot axis 40 located at the bottom on the vertical axis Z of the printer. When in the closed position 3A shown in FIG. 2, the reversing unit 3 is standing upright on the vertical axis Z, and the back cover 42 of the reversing unit case 41 is positioned substantially flush with the back left and right sides of the printer cabinet 2. In the open position 3B shown in FIG. 4, the reversing unit 3 is dropped to the back on the longitudinal axis Y to a substantially level position. In the open position 3B, the ascending path 29 on the downstream side of the reversing conveyance path 14, and the common path 30, are open as will be understood from FIG. 4. Paper jams and other problems occurring on these conveyance paths can be easily handled by opening the reversing unit 3.

As shown in FIG. 2, the reversing unit 3 has an opening 42*a* in the middle at the top of the back cover 42 on the vertical axis Z. A pair of lever operators 43 are exposed through this opening 42*a*. When the pair of lever operators 43 is operated so that they close together, left and right lock pins 44 (FIG. 4) protruding to the side from the left and right sides of the reversing unit 3 disengage matching catches 45 (FIG. 4) formed in the left and right sides of the printer cabinet 2. The reversing unit 3 is thus unlocked and can be opened.

Print Mechanism Unit

Figure 5:
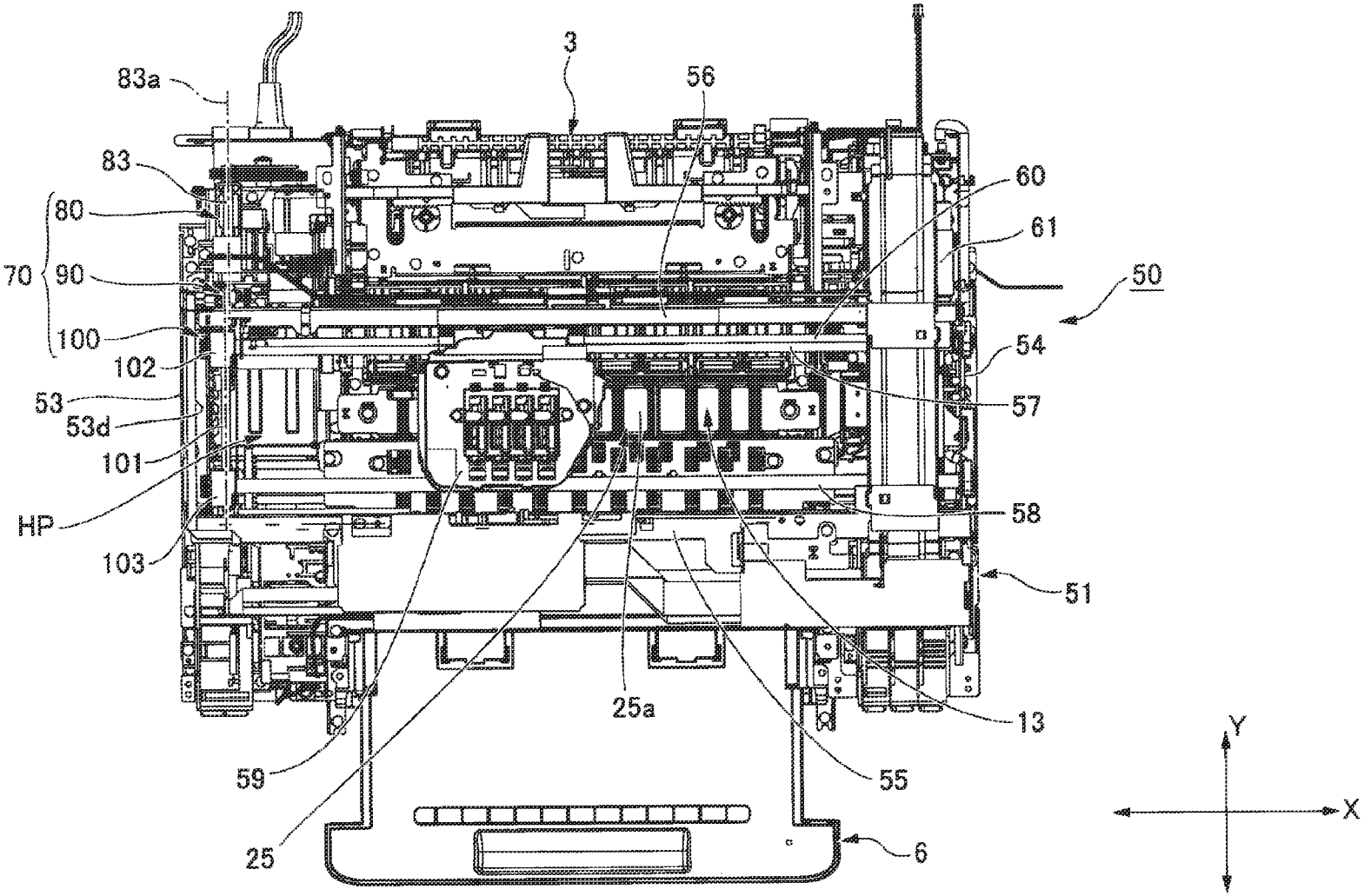
FIG. 5 is a plan view showing the print mechanism unit of the printer shown in FIG. 1.
Figure 6:
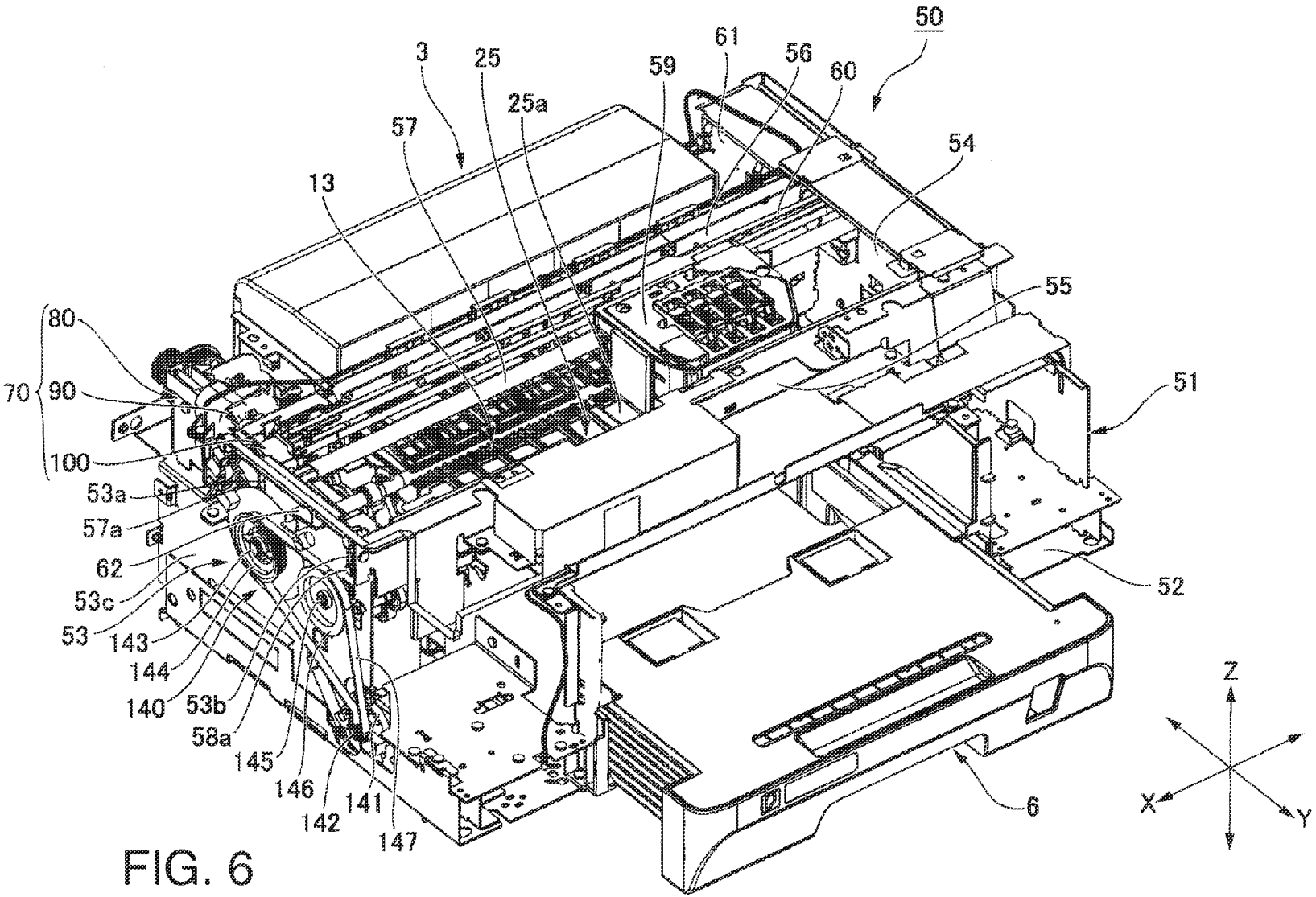
FIG. 6 is an oblique view from the front of the print mechanism unit shown in FIG. 5.
Figure 7:
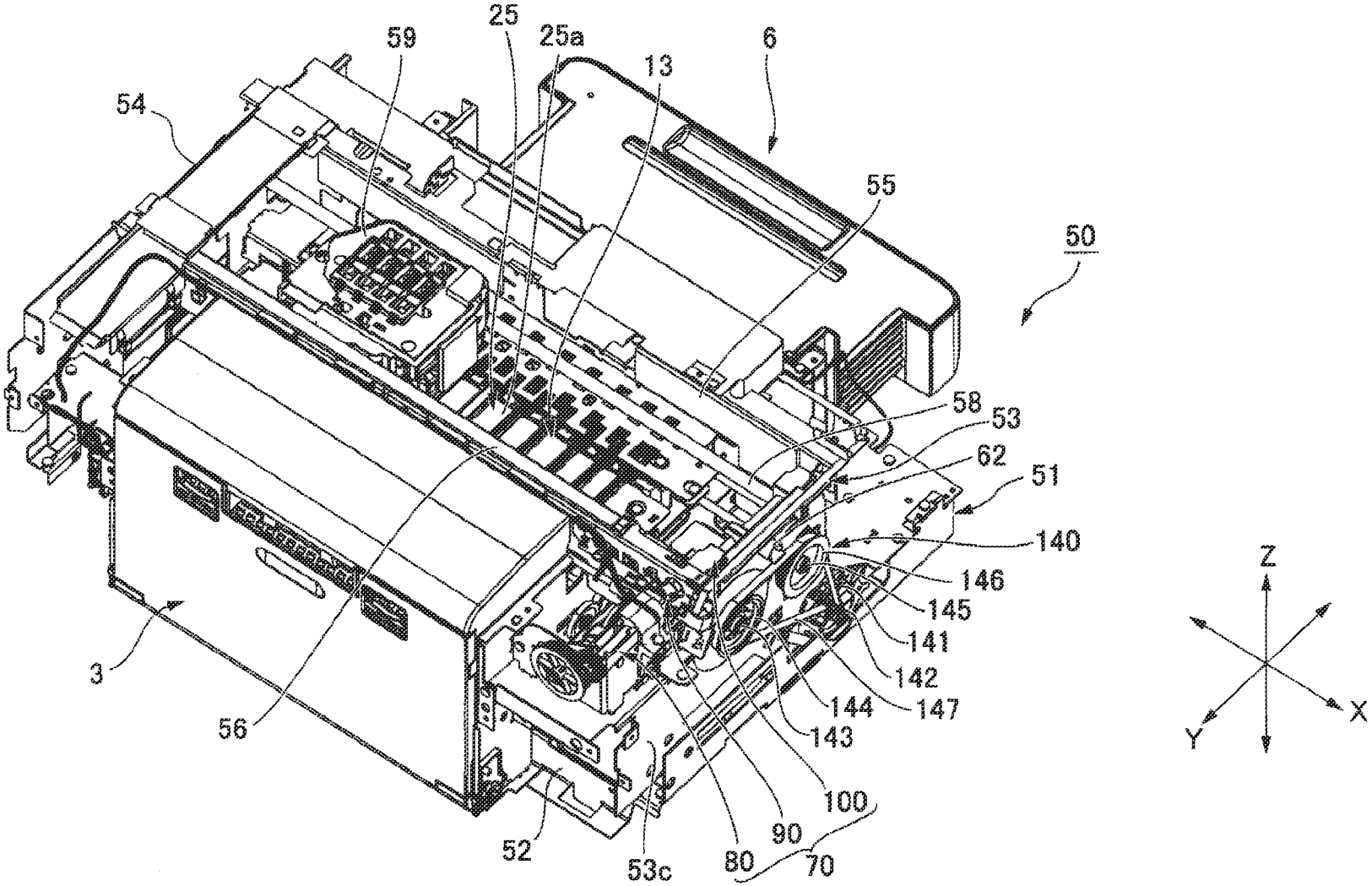
FIG. 7 is an oblique view from the back of the print mechanism unit shown in FIG. 5.

FIG. 5 to FIG. 7 are a plan view, and oblique views from the front and back, respectively, of the print mechanism unit that is covered by the main case 2A of the printer 1. FIG. 5 shows the print mechanism unit with the main case 2A, paper discharge tray 7, and unit case 41 of the reversing unit 3 removed, and FIG. 6 and FIG. 7 show the print mechanism unit with the main case 2A and the paper discharge tray 7 removed.

As shown in the figures, the print mechanism unit 50 includes a sheet metal print unit frame 51 to which parts of the print mechanism unit 50 are assembled. The print unit frame 51 includes a base frame 52, and printer side frames 53, 54 rising perpendicularly from the base frame 52 at positions on opposite sides of the transverse axis X. A front frame 55 and a rear frame 56 span transversely between the printer side frames 53, 54 (referred to below as side frames).

Two carriage guide rails 57, 58 span parallel to the transverse axis X between the front frame 55 and rear frame 56 at positions between the top parts of the side frames 53, 54 on the vertical axis. The carriage guide rail 57 located on the rear frame 56 side is referred to below as the first guide rail 57, and the carriage guide rail 58 located on the front frame 55 side is referred to as the second guide rail 58. A head carriage 59 is mounted on the first and second guide rails 57, 58.

The head carriage 59 can slide on the transverse axis X along the first and second guide rails 57, 58. The head carriage 59 is connected to a timing belt 60 extending on the transverse axis X at a position near the first guide rail 57. The timing belt 60 is driven by a carriage drive motor 61.

The printhead 22 is mounted on the head carriage 59. The printhead 22 is mounted on the head carriage 59 with the nozzle face 22*a* (FIG. 3) facing down. A platen 25 is disposed below the printhead 22. The platen 25 is a multi-part platen having plural platen segments 25*a* side by side on the transverse axis X, which is the direction of printhead 22 travel. The printhead 22 can move by means of the head carriage 59 between the home position HP near one side frame 53, and an away position near the other side frame 54. In other words, the printhead 22 can travel reciprocally widthwise across the main conveyance path 13 (print medium conveyance path) formed between the side frames 53, 54.

The power transfer mechanism 140 of the media conveyance rollers is assembled to the outside surface 53*c* of the side frame 53 facing the outside of the printer. In this example, the power transfer mechanism 140 of the paper feed roller pair 21 and first discharge roller pair 23, which are media conveyance rollers, is assembled to the outside surface 53*c*. The paper feed roller pair 21 and first discharge roller pair 23 are disposed to the main conveyance path 13, which is the print medium conveyance path, on the upstream and downstream sides of the platen 25, respectively, and below the first and second guide rails 57, 58 (FIG. 3).

The power transfer mechanism 140 is described next with reference to FIG. 6 and FIG. 7. A paper feed motor 141 is mounted on the base frame 52 on the side frame 53 side. The paper feed motor 141 is disposed facing the outside of the printer on the transverse axis X, and a pinion 142 is fixed coaxially to the distal end of the motor shaft.

The end part 143 of the roller shaft of the drive roller in the paper feed roller pair 21 is supported freely rotationally by the side frame 53, and protrudes to the outside. A transfer gear 144 is fixed coaxially to the protruding end part 143.

The end part 145 of the roller shaft of the drive roller of the first discharge roller pair 23 is similarly supported freely rotationally by the side frame 53, and protrudes to the outside. A transfer gear 146 is fixed coaxially to the protruding end part 145.

A timing belt 147 is mounted on the pinion 142, transfer gear 144, and transfer gear 146.

Platen Gap Adjustment Mechanism

A platen gap adjustment mechanism 70 capable of adjusting the gap between the printhead 22 and platen 25 is also disposed to the print mechanism unit 50. The gap between the printhead 22 and platen 25 is the distance from the nozzle face 22*a* of the printhead 22 to the surface of the platen 25, or the distance from the nozzle face 22*a* to the surface of the paper P conveyed over the platen 25. Both of these distances are called the platen gap in this embodiment of the invention.

In this embodiment the platen 25 is mounted on the print unit frame 51 side at a fixed position on the vertical axis Z. The platen gap adjustment mechanism 70 moves the two first and second guide rails 57, 58 positioned above the platen 25 on the vertical axis Z, and thereby increases or decreases the platen gap. The vertical axis Z is therefore the gap adjustment direction. Alternatively, the first and second guide rails 57, 58 could be fixed on the print unit frame 51 side, and the platen 25 moved on the vertical axis Z to adjust the platen gap.

Figure 8:
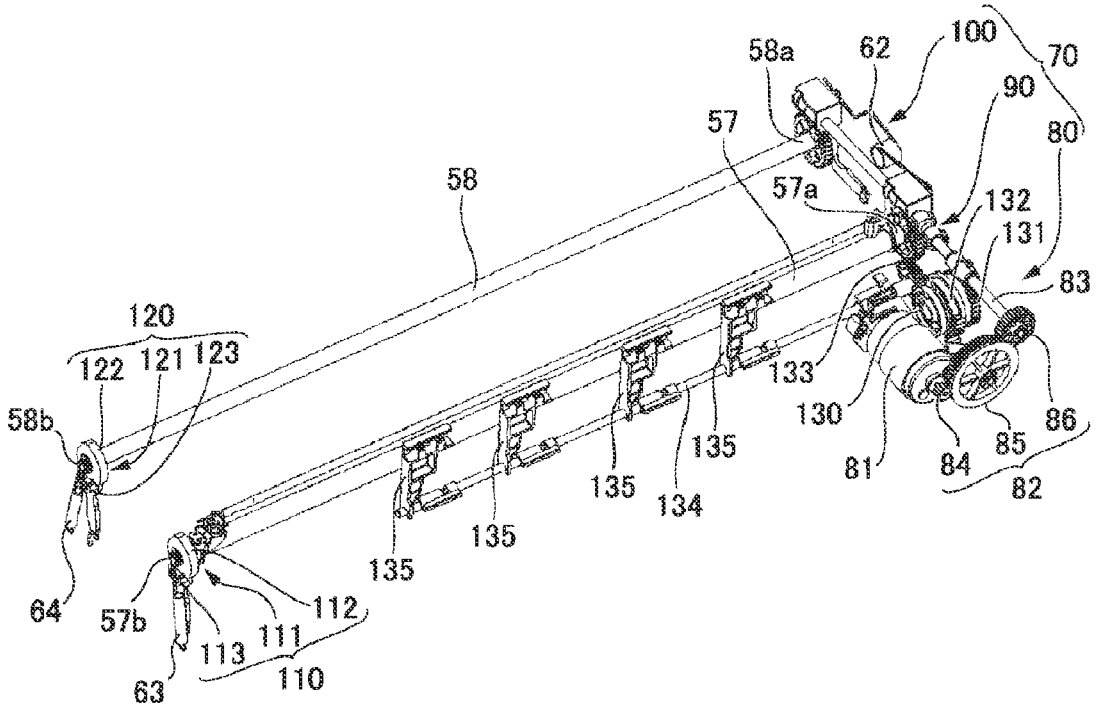
FIG. 8 is an oblique view from the back of the platen gap adjustment mechanism of the printer shown in FIG. 1.
Figure 9:
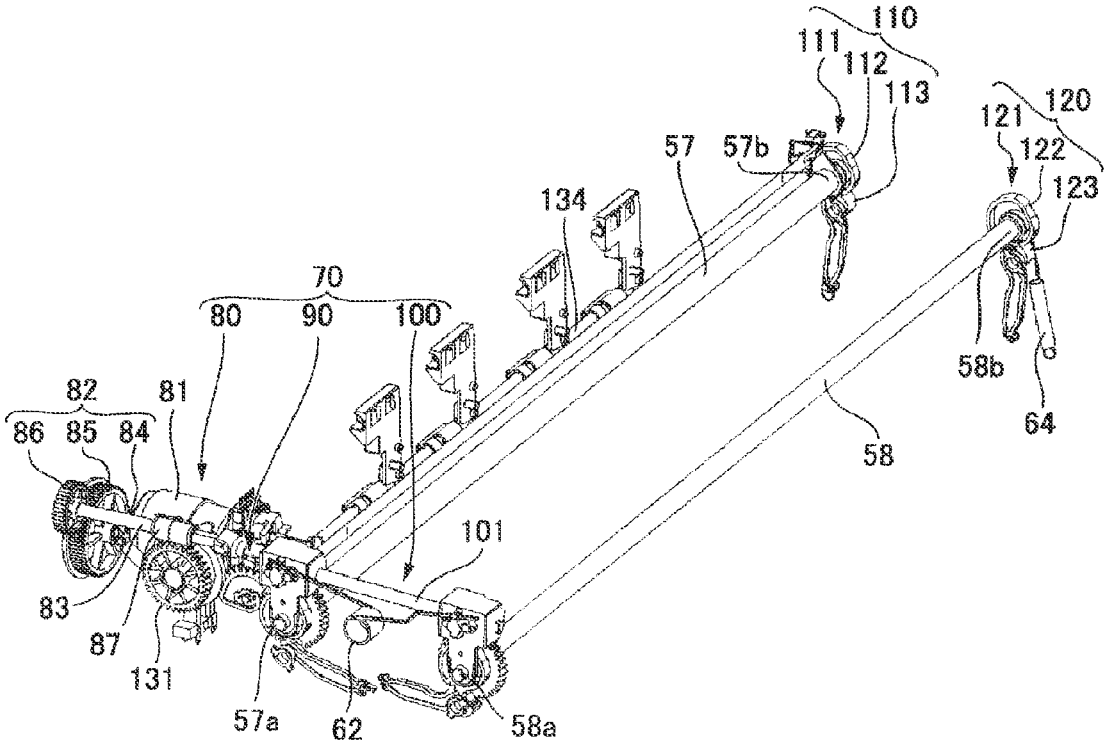
FIG. 9 is an oblique view from the front of the platen gap adjustment mechanism shown in FIG. 8.

FIG. 8 and FIG. 9 are oblique views showing the main part of the platen gap adjustment mechanism 70 removed from the print mechanism unit 50. These figures show the main parts of the platen gap adjustment mechanism 70 from different directions. The platen gap adjustment mechanism 70 includes a stationary part 80, a movable part 100, a universal joint 90, and rotary cam mechanisms 110, 120.

The stationary part 80 includes stationary-side components mounted on the print unit frame 51 side. The movable part 100 includes components that can move on the vertical axis Z with the first and second guide rails 57, 58. The universal joint 90 transfers torque from the stationary part 80 to the movable part 100.

The stationary part 80 is disposed on the back side of the rear frame 56 at the end near the side frame 53.

The movable part 100 is disposed along the inside surface 53*d* of the side frame 53. The movable part 100 includes a rotary transfer mechanism that transfers rotation to the first and second guide rails 57, 58. The rotary transfer mechanism in this example is a synchronous rotary mechanism that synchronously rotates the first and second guide rails 57, 58.

The rotary cam mechanisms 110, 120 are each disposed to both the inside surface of side frame 53 and the inside surface of side frame 54. The rotary cam mechanisms 110, 120 are cam mechanisms that convert rotation of the first and second guide rails 57, 58 to movement of the first and second guide rails 57, 58 in the gap adjustment direction.

Figure 10:
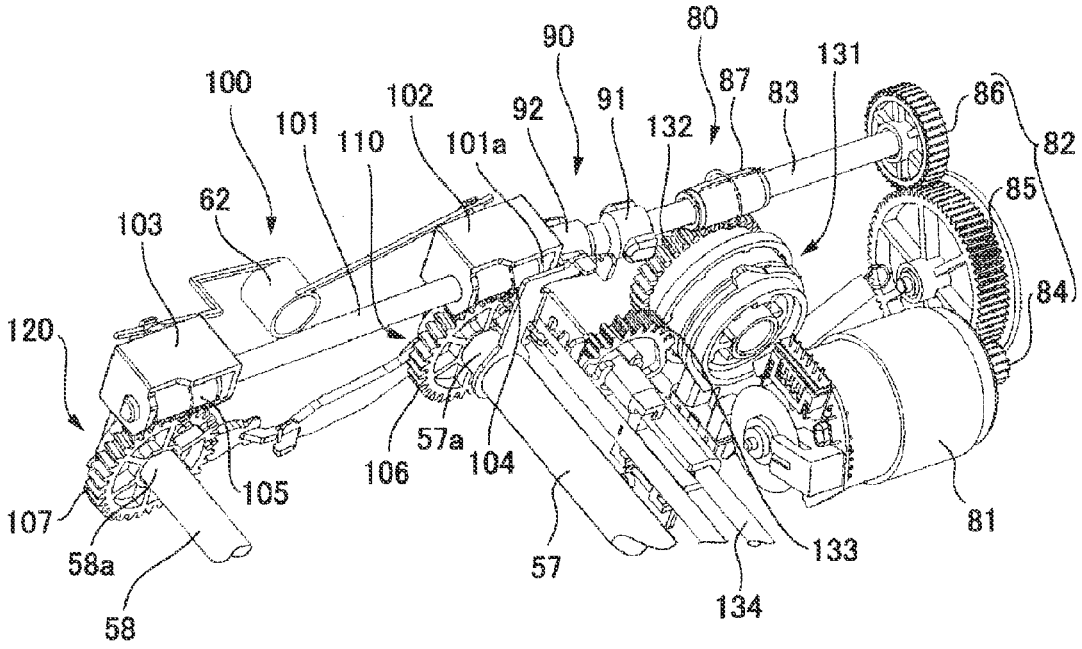
FIG. 10 is a partial oblique view showing a main part of the platen gap adjustment mechanism shown in FIG. 8.
Figure 11:
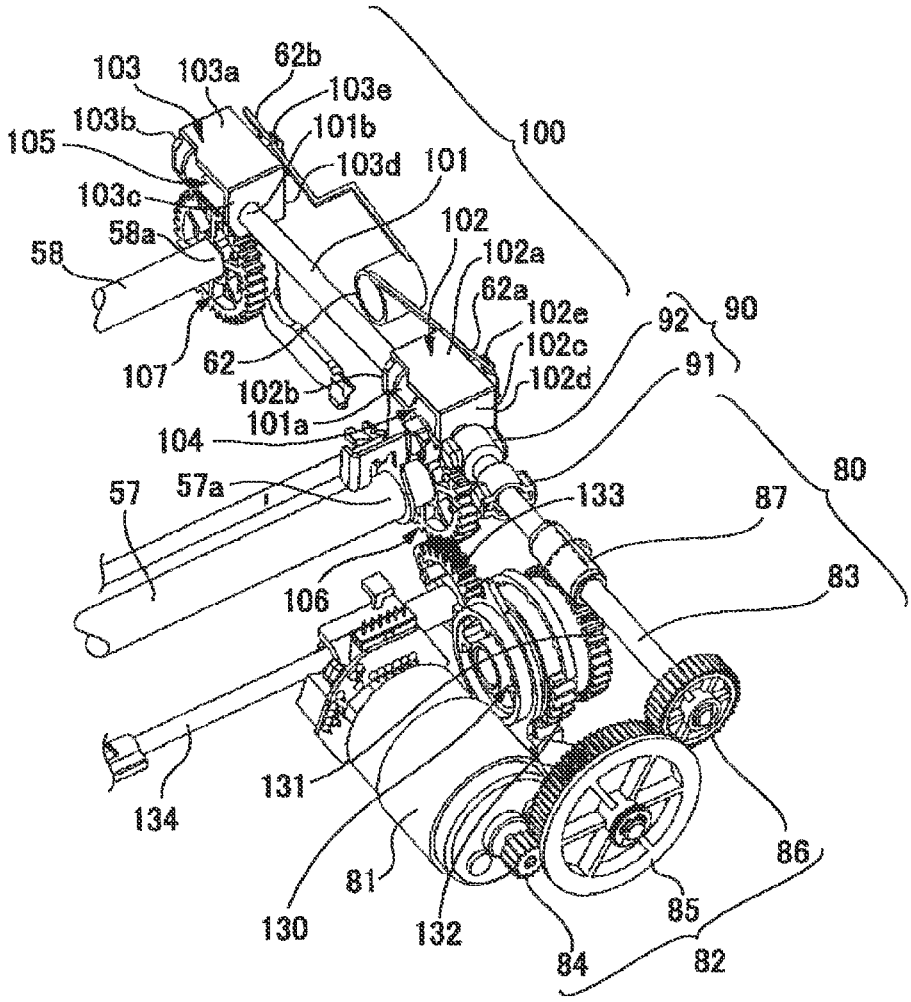
FIG. 11 is a partial oblique view showing a main part of the platen gap adjustment mechanism shown in FIG. 8.
Figure 12:
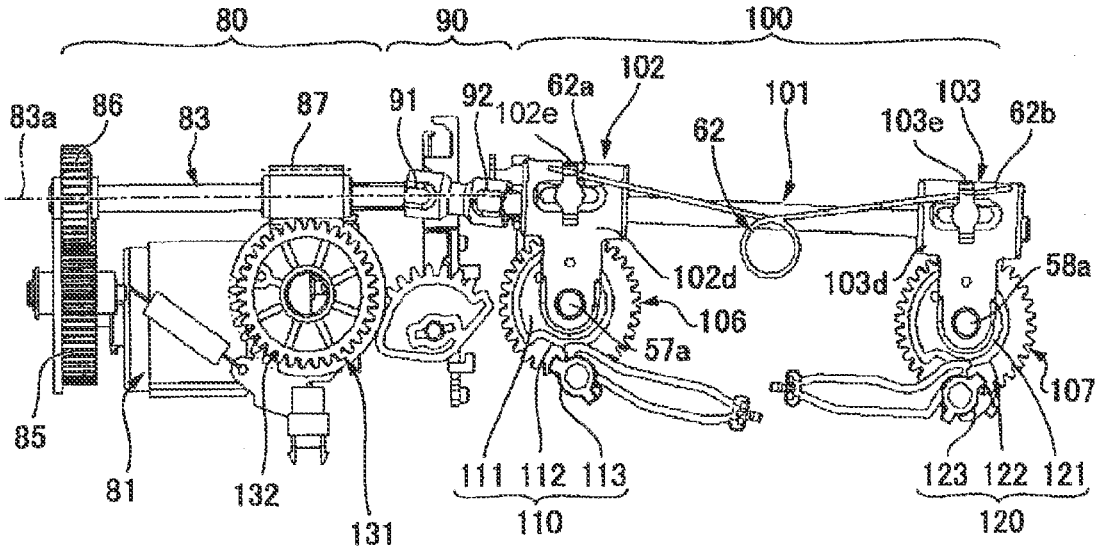
FIG. 12 is a partial side view showing a main part of the platen gap adjustment mechanism shown in FIG. 8.

FIG. 10, FIG. 11, and FIG. 12 are, respectively, an oblique view from the front, an oblique view from the back, and a side view from the side of the printer width showing main parts of the platen gap adjustment mechanism 70. The configuration of the platen gap adjustment mechanism 70 is described in detail below with reference particularly to FIG. 8 to FIG. 11.

Stationary-side Part

The stationary part 80 of the platen gap adjustment mechanism 70 includes a motor 81 as a rotary drive source, a power transfer gear train 82, and a stationary-side rotary shaft 83. These parts are fastened to the print unit frame 51 side through a unit case. The motor 81 is disposed horizontally facing the back of the printer. The stationary-side rotary shaft 83 is disposed near the motor 81 with the axis of rotation 83*a* extending horizontally in the front-back direction (on the longitudinal axis Y) of the printer. The power transfer gear train 82 includes a pinion 84 fixed to the output shaft of the motor 81, an intermediate transfer gear 85 meshed with the pinion 84, and a shaft-side transfer gear 86 meshed with the intermediate transfer gear 85. The shaft-side transfer gear 86 is fixed coaxially to the back end of the stationary-side rotary shaft 83.

A worm 87 is formed in unison the stationary-side rotary shaft 83 at the middle in the axial direction. Below the worm 87 is a compound gear 130 with its axis of rotation on the transverse axis X perpendicular to the stationary-side rotary shaft 83.

The worm wheel 131 of the compound gear 130 meshes with the worm 87. The compound gear 130 has an external gear 132 with teeth formed in a specific angular range along the circumference. The external gear 132 can mesh with a fan-shaped external gear 133 within a specific angular range in one revolution. The fan-shaped external gear 133 is a gear with external teeth formed in an arc of a specific angle.

A rotary shaft 134 extends horizontally on the transverse axis X behind the first guide rail 57. Rotatable roller support arms 135 are disposed to the rotary shaft 134 at a specific interval along the axial direction (see FIG. 8). The roller support arms 135 support the follower roller 18 that is pressed against the conveyance roller 17 (see FIG. 3). By turning the rotary shaft 135 within a specific angular range, the follower roller 18 supported by the roller support arms 135 can be moved between the position pressed against the conveyance roller 17, and a release position separated from the conveyance roller 17.

The universal joint 90 includes a stationary-side coupling 91 and a movable-side coupling 92. The stationary-side coupling 91 is connected to the end of the stationary-side rotary shaft 83 of the stationary part 80 toward the back of the printer. The movable-side coupling 92 of the universal joint 90 passes with sufficient play through a through-hole in the rear frame 56, and protrudes toward the movable part 100 on the side toward the front of the printer.

Movable Part

The movable part 100 can move in the gap adjustment direction (the vertical axis Z) guided by the side frames 53, 54. As will be understood from FIG. 6 and FIG. 7, guide holes 53*a*, 53*b* that extend parallel to the vertical axis Z, which is the gap adjustment direction, are formed in the side frame 53. One end 57*a*, 58*a* of the first and second guide rails 57, 58 protrudes through to the outside slidably in the guide holes 53*a*, 53*b*. A pair of guide holes (not shown in the figure) are likewise formed in the side frame 54 on the opposite side, and the other end 57*b*, 58*b* (FIG. 8, FIG. 9) of the first and second guide rails 57, 58 protrudes through to the outside slidably in these guide holes.

The first and second guide rails 57, 58 can slide on the vertical axis Z guided by the guide holes 53*a*, 53*b*. As shown in FIG. 6 to FIG. 10, a torsion spring 62 is attached to the outside surface 53*c* of the side frame 53 at a position above the power transfer mechanism 140. The one end 57*a*, 58*a* of the first and second guide rails 57, 58 is constantly urged down on the vertical axis Z by the torsion spring 62.

As shown in FIG. 8 and FIG. 9, tension springs 63, 64 are mounted between the other end 57*b*, 58*b* of the first and second guide rails 57, 58 and a lower position on the side frame 54. The other ends 57*b*, 58*b* are thus constantly urged down on the vertical axis Z.

The movable part 100 has a movable-side rotary shaft 101 extending horizontally on the longitudinal axis Y. The movable-side rotary shaft 101 is located above the side frame 53 side ends 57*a*, 58*a* of the first and second guide rails 57, 58, and extends horizontally on the longitudinal axis Y along the inside surface 53*d* of the side frame 53. More specifically, the movable-side rotary shaft 101 extends perpendicularly to the first and second guide rails 57, 58. The opposite ends 101*a*, 101*b* of the movable-side rotary shaft 101 are supported freely rotatably by a first bracket 102 and a second bracket 103. The first and second brackets 102, 103 hold the movable-side rotary shaft 101 and the first and second guide rails 57, 58 with a specific gap therebetween (in a specific position relative to each other).

As shown in FIG. 11, the first bracket 102 has a top plate 102*a*, front and back end plates 102*b*, 102*c*, and a side plate 102*d*. The movable-side rotary shaft 101 is supported freely rotatably by the front and back end plates 102*b*, 102*c*. The end 57*a* of the first guide rail 57 passes rotatably through the bottom part of the side plate 102*d*.

The second bracket 103 is configured the same way with a top plate 103*a*, front and back endplates 103*b*, 103*c* that support the movable-side rotary shaft 101 freely rotatably, and a side plate 103*d* through which the end 58*a* of the second guide rail 58 passes freely rotatably.

A spring catch 102*e*, 103*e* is formed at a place near the top of the side plate 102*d*, 103*d* of the first and second brackets 102, 103, respectively. The opposite ends 62*a*, 62*b* of the torsion spring 62 mounted on the outside of the side frame 53 engage the tops of the spring catches 102*e*, 103*e*. The movable part 100 is constantly urged down on the vertical axis Z by the spring force of the torsion spring 62.

The end 101*a* of the movable-side rotary shaft 101 on the back side of the printer is connected to the movable-side coupling 92 of the universal joint 90. Rotation from the stationary-side rotary shaft 83 is transferred through the universal joint 90 to the movable-side rotary shaft 101. The universal joint 90 enables the movable-side rotary shaft 101 to move within a specific range on the vertical axis Z, which is the gap adjustment direction, relative to the stationary-side rotary shaft 83. The movable-side rotary shaft 101 can also move within a specific range on the transverse axis X relative to the stationary-side rotary shaft 83. As will be understood from FIG. 5, the movable-side rotary shaft 101 is disposed horizontally on the longitudinal axis Y at a position offset slightly to the outside on the transverse axis X from the stationary-side rotary shaft 83.

As will be understood from FIG. 10 and FIG. 11, a first worm 104 (first drive-side gear) is formed in unison with the outside surface of the movable-side rotary shaft 101 on the end 101*a* toward the back of the printer. A second worm 105 (second drive-side gear) is also formed on the outside surface of the other end 101*b*. The first and second worms 104, 105 are identical worms. The first and second worms 104, 105 are covered on three sides, the top and front and back, by the first and second brackets 102, 103.

The first worm 104 meshes with a first worm wheel 106 (first driven-side gear) fixed coaxially to the end 57*a* of the first guide rail 57. The second worm 105 likewise meshes with a second worm wheel 107 fixed coaxially to the end 58*a* of the second guide rail 58. The first and second worm wheels 106, 107 are identical worm wheels.

Rotation of the movable-side rotary shaft 101 is transferred through the first and second worms 104, 105 and the first and second worm wheels 106, 107 to the first and second guide rails 57, 58. The first and second guide rails 57, 58 are synchronously driven rotationally. A synchronous rotary mechanism that synchronously drives the first and second guide rails 57, 58 rotationally is thus configured by the movable-side rotary shaft 101, the first and second worms 104, 105, and the first and second worm wheels 106, 107.

Rotary Cam Mechanism

As shown in FIG. 8, FIG. 9, and FIG. 12, identically configured rotary cam mechanisms 110 are assembled to each end 57*a*, 57*b* of the first guide rail 57. Identically configured rotary cam mechanisms 120 are likewise assembled to each end 58*a*, 58*b* of the second guide rail 58. The rotary cam mechanism 110 and the rotary cam mechanism 120 are identically configured rotary cam mechanisms.

The rotary cam mechanism 110 is a conversion mechanism that converts rotation of the first guide rail 57 to movement of the first guide rail 57 in the gap adjustment direction, that is, the vertical axis Z. The rotary cam mechanism 120 is likewise a conversion mechanism that converts rotation of the second guide rail 58 to movement of the second guide rail 58 in the gap adjustment direction.

The rotary cam mechanism 110 on the first guide rail 57 at end 57*a* has a rotary cam 111 fixed to the rail end 57*a*. An external cam surface 112 is formed on the rotary cam 111. A cam follower 113 that slidably contacts the external cam surface 112 from below is disposed to the inside surface of the side frame 53. The shape of the external cam surface 112 is formed so that the point of contact between the external cam surface 112 and the cam follower 113 moves in the gap adjustment direction (vertical axis Z) in conjunction with rotation of the rotary cam 111. An identically configured rotary cam mechanism 110 is disposed to the other end 57*b* of the first guide rail 57.

As will be understood from FIG. 12, the external cam surface 112 is shaped so that the distance from the center of rotation (the axis of rotation of the first guide rail 57) increases gradually through a specific angular range along the outside surface. When the rotary cam 111 turns clockwise in the figure from the phase of rotation shown in FIG. 12, the external cam surface 112 contacts the cam follower 113. As the rotary cam 111 continues to turn, the external cam surface 112 is pushed up by the stationary cam follower 113. As a result, the end 57*a* of the first guide rail 57 moves up.

As shown in FIG. 8, FIG. 9, and FIG. 12, the rotary cam mechanism 120 disposed on the end 58*a* of the second guide rail 58 is configured identically to the rotary cam mechanism 110 described above, and has a rotary cam 121, an external cam surface 122 formed on the rotary cam 121, and a cam follower 123. The rotary cam mechanism 120 disposed on the other shaft end 58*b* is identically configured.

The rotary cam 121 and cam follower 123 are disposed in the same phase of rotation as the rotary cam 111 and cam follower 113 of the rotary cam mechanism 110. Therefore, when the first and second guide rails 57, 58 are synchronously turned, the rotary cam mechanisms 110, 120 turn in the same phase of rotation, and the ends 57*a*, 57*b* of the first guide rail 57 and the ends 58*a*, 58*b* of the second guide rail 58 are moved the same amount on the vertical axis Z, which is the gap adjustment direction. The movable part 100 therefore moves on the vertical axis Z while remaining substantially horizontal. The printhead 22 on the movable side therefore moves relative to the platen 25 on the stationary side, and the platen gap is adjusted.

Effect of the Invention

In the platen gap adjustment mechanism 70 described above, rotation of the motor 81 of the stationary part 80 is transferred from the stationary-side rotary shaft 83 through the universal joint 90 to the movable-side rotary shaft 101 of the movable part 100. In the movable part 100, a synchronous rotary mechanism that synchronously drives the first and second guide rails 57, 58 is embodied by the movable-side rotary shaft 101, first and second worms 104, 105, and first and second worm wheels 106, 107. Compared with a synchronous rotary mechanism comprising a gear train of plural spur gears between the first and second guide rails 57, 58, the synchronous rotary mechanism of the invention can be configured using fewer parts and consumes less space.

The first and second worms 104, 105 are formed in unison with the movable-side rotary shaft 101 and therefore rotate perfectly synchronized with the movable-side rotary shaft 101. Because the first and second worms 104, 105 also mesh with the first and second worm wheels 106, 107 disposed on a perpendicular axis of rotation, there is less backlash compared with meshed spur gears on parallel axes of rotation. More particularly, because this embodiment uses cylindrical worm gear pairs, there is zero backlash. The platen gap can therefore be adjusted with good precision because the first and second guide rails 57, 58 can be synchronously turned with good precision.

A high speed reduction ratio comparable to a gear train using numerous spur gears can also be achieved by using a two-gear configuration consisting of a worm and a worm wheel. Because fewer gear are therefore required to achieve a specific speed reduction ratio, a small, compact platen gap adjustment mechanism 70 can be achieved.

The first and second worms 104, 105 and first and second worm wheels 106, 107 also mesh on perpendicular axes of rotation. Force moving the first and second worm wheels 106, 107 in the direction of rotation is also not applied from the first and second worms 104, 105, the drive gears, to the first and second worm wheels 106, 107, the driven gears. In other words, the force moving the first and second guide rails 57, 58 in the gap adjustment direction is not applied. Unlike a geared transfer mechanism composed of meshed spur gears, great force in the gap adjustment direction is not applied to the first and second guide rails 57, 58. Small springs can also be used for the torsion spring 62 and the tension springs 63, 64 that prevent the first and second guide rails 57, 58 from moving in the gap adjustment direction.

The first and second guide rails 57, 58 also turn synchronously with good precision with this platen gap adjustment mechanism 70. There is therefore no need to allow for play in the rotary cam mechanisms 110, 120 that convert rotation of the first and second guide rails 57, 58 to movement of these shafts in the gap adjustment direction in order to absorb deviation in the synchronous rotation of the first and second guide rails 57, 58. A small diameter is therefore sufficient in the external cam surfaces 112, 122 of the rotary cams 111, 121. Because small diameter rotary cams 111, 121 can therefore be used, the rotary cams 111, 121 can be used to reduce the size of the platen gap adjustment mechanism 70. The platen gap can therefore be adjusted quickly and efficiently.

The stationary-side rotary shaft 83 of the stationary part 80 and the movable-side rotary shaft 101 of the movable part 100 are connected by a universal joint 90. Torque from the stationary-side rotary shaft 83 to the movable-side rotary shaft 101 is transferred even if the movable-side rotary shaft 101 is displaced in the gap adjustment direction. When rotation is transferred from the stationary-side rotary shaft 83 to the movable-side rotary shaft 101 by meshing spur gears, the movable-side rotary shaft 101 cannot move greatly in the gap adjustment direction because of the need to keep the spur gears meshed. By using a universal joint, however, the range of movement can be increased for the movable-side rotary shaft 101 compared with the related art, and a platen gap adjustment mechanism enabling a large gap adjustment can be easily achieved.

By using a universal joint 90, the movable-side rotary shaft 101 of the movable part 100 can also be offset on the transverse axis X from the stationary-side rotary shaft 83 of the stationary part 80. Greater freedom is therefore possible in the layout of the platen gap adjustment mechanism 70.

The movable part 100, and the rotary cam mechanisms 110, 120 of the platen gap adjustment mechanism 70 are disposed along the inside surface 53*d* of the side frame 53. The power transfer mechanism 140 for media conveyance is disposed to the outside surface of the side frame 53. By thus using space on the inside of the printer side frame 53, the platen gap adjustment mechanism 70 can be disposed to the printer side frames 53, 54 on either side of the main conveyance path 13 without being restricted by the power transfer mechanism 140. Because placement of the platen gap adjustment mechanism 70 is thus not limited by the power transfer mechanism 140 for media conveyance, and the platen gap adjustment mechanism 70 can be disposed on either side of the paper conveyance path, greater freedom is achieved in the layout of the platen gap adjustment mechanism 70.

As described above, the movable part 100 of the platen gap adjustment mechanism 70 is small, compact, and has few parts. The platen gap adjustment mechanism 70 can therefore be easily disposed on the side of either side frame 53, 54 located on opposite sides of the main conveyance path 13 regardless of whether the media conveyance power transfer mechanism 140 is on the same side.

The invention therefore enables configuring a printer 1 with the platen gap adjustment mechanism 70 on the side of either side frame 53, 54 on opposite sides of the main conveyance path 13 regardless of whether the media conveyance power transfer mechanism 140 is on the same side.

Because the movable part 100 of the platen gap adjustment mechanism 70 is disposed on the inside of the side frame 53, a part of the movable part 100 can be used as a contact member that can contact the head carriage 59. A contact member can alternatively be disposed to the movable part 100.

For example, an edge of the first and second brackets 102, 103 of the movable part 100 on the inside on the transverse axis X can be used as a stop that contacts the head carriage 59. More specifically, if when moving toward the side frame 53 the head carriage 59 moves beyond a specific limit toward the side frame 53, a side part of the head carriage 59 could be made to contact a stop formed on the first and second brackets 102, 103.

The head carriage 59 is supported slidably widthwise to the printer by two first and second guide rails 57, 58 in the printer 1 described above, and a printhead 22 is mounted on the head carriage 59. The invention can also be applied to a printer configured to support the head carriage 59 slidably widthwise by a single guide rail. In this configuration, a movable rotary shaft 101 with a worm in one place, and a worm wheel attached to an end of the guide rail, can be used instead of the synchronous rotary mechanism described above. The movable rotary shaft 101 and the stationary rotary shaft 83 are also connected by a universal joint 90 in this configuration.

The invention can also be used as a platen gap adjustment mechanism in a line printer.

The foregoing embodiment uses a worm and a worm wheel to transfer rotation of the movable rotary shaft 101 to the guide rail. Alternatively, a drive-side bevel gear could be disposed coaxially to the guide rail, and a driven-side bevel gear that meshes with the drive-side bevel gear disposed on the guide rail side.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead;

a head carriage carrying the printhead;

a first guide rail and a second guide rail that are mutually parallel and support the head carriage;

a platen opposite the printhead; and a platen gap adjustment mechanism that adjusts a gap between the printhead and the platen by moving the first and second guide rails along a gap adjustment direction to approach or recede from the platen, said platen gap adjustment mechanism having a rotary mechanism that synchronously drives the first guide rail and the second guide rail in synchronous rotation, wherein the moving of the first and second guide rails along the gap adjustment direction is dependent upon the synchronous rotation of the first and second guide rails;

said rotary mechanism including:

a rotary shaft extending perpendicularly to the first guide rail and the second guide rail, a first drive-side gear and a second drive-side gear coaxially attached to the rotary shaft, a first driven-side gear coaxially attached to the first guide rail and meshing with the first drive-side gear, and a second driven-side gear coaxially attached to the second guide rail and meshing with the second drive-side gear.

2. The printer described in claim 1, wherein:

the first drive-side gear and the second drive-side gear are worms, and the first driven-side gear and the second driven-side gear are worm wheels.

3. The printer described in claim 1, wherein the platen gap adjustment mechanism further includes:

a first cam mechanism that converts rotation of the first guide rail to movement of the first guide rail along the gap adjustment direction, and a second cam mechanism that converts rotation of the second guide rail to movement of the second guide rail along the gap adjustment direction, the first and second cam mechanisms being identically configured cam mechanisms, wherein:

the first cam mechanism includes a first rotary cam coaxially attached to the first guide rail and having a first outside cam surface, and the second cam mechanism includes a second rotary cam coaxially attached to the second guide rail and having a second outside cam surface;

a first cam follower disposed in a first fixed position along the gap adjustment direction and having a sliding contact point with the first outside cam surface, wherein the shape of the first outside cam surface causes the contact point of the first outside cam surface and the first cam follower to move along the gap adjustment direction with rotation of the first rotary cam; and a second cam follower disposed in a second fixed position along the gap adjustment direction and having a sliding contact point with the second outside cam surface, wherein the shape of the second outside cam surface causes the contact point of the second outside cam surface and the second cam follower to move along the gap adjustment direction with rotation of the second rotary cam.

4. The printer described in claim 3, wherein:

the parallel first and second guide rails have respective first ends along a first longitudinal direction, and respective second ends along a second longitudinal direction opposite the first longitudinal direction;

the first driven-side gear is fixed to the first end of the first guide rail;

the second driven-side gear is fixed to the second end of the second guide rail;

the first cam mechanism includes two of said first rotary cams, one disposed at the first end of the first guide rail and the other disposed at the second end of the first guide rail; and the second cam mechanism includes two of said second rotary cams, one disposed at the first end of the second guide rail and the other disposed at the second end of the second guide rail.

5. The printer described in claims 1, wherein the platen gap adjustment mechanism includes:

a rotational drive source disposed at a fixed position along the gap adjustment direction;

a stationary-side rotary shaft rotationally driven by the rotational drive source; and a universal coupling that connects the stationary-side rotary shaft to the rotary shaft of the rotary mechanism of the platen gap adjustment mechanism.

6. A printer comprising:

a printhead;

a platen opposite the printhead; and a platen gap adjustment mechanism that adjusts a gap between the printhead and the platen, a direction along which the gap increases or decreases being a gap adjustment direction, said platen gap adjustment mechanism including:

a movable part defined by a first assembly that can be displaced along the gap adjustment direction, said first assembly including a movable-side rotary shaft, a stationary part defined by a second assembly that is stationary and disposed at a fixed position along the gap adjustment direction, said second assembly including a stationary-side rotary shaft, and a universal joint unit connecting the stationary-side rotary shaft to the movable-side rotary shaft;

wherein the printhead is disposed to the movable part, and the platen is disposed at a fixed position.

7. The printer described in claim 6, wherein the universal joint unit includes:

a stationary-side universal joint part coupled to the stationary-side rotary shaft; and a movable-side universal joint part coupled to the movable-side rotary shaft.

8. The printer described in claim 6, further comprising:

a head carriage on which the printhead is mounted; and a guide rail that supports the head carriage slidably in a direction perpendicular to the gap adjustment direction, the guide rail being mounted to the movable part.

9. The printer described in claim 8, wherein the platen gap adjustment mechanism includes:

a rotary transfer mechanism that transfers rotation of the movable-side rotary shaft to rotation of the guide rail; and a cam mechanism that converts rotation of the guide rail to displacement movement of the movable part along the gap adjustment direction.

10. The printer described in claim 9, wherein the rotary transfer mechanism includes a worm disposed coaxially to the movable-side rotary shaft, and a worm wheel disposed coaxially to the guide rail and meshing with the worm.

11. The printer described in claim 9, wherein the cam mechanism includes:

a rotary cam having an outside cam surface and rotating in unison with the guide rail; and a cam follower disposed at a fixed position in the gap adjustment direction and slidably contacting the outside cam surface;

wherein the outside cam surface is shaped so that a contact position of the outside cam surface and the cam follower moves along the gap adjustment direction with rotation of the rotary cam.

12. A printer comprising:

a printhead;

a head carriage on which the printhead is mounted;

a guide rail that supports the head carriage slidably widthwise to a print medium conveyance path;

a platen disposed opposite the printhead with the print medium conveyance path therebetween;

a platen gap adjustment mechanism that adjusts a gap between the printhead and the platen by displacing the guide rail in a gap adjustment direction defined as a directional path toward or away from the platen; and opposing printer side-frames disposed on opposite sides of the width of the print medium conveyance path and supporting the opposite ends of the guide rail movably in the gap adjustment direction;

the platen gap adjustment mechanism including a rotary transfer mechanism that transfers rotation to the guide rail, and a cam mechanism that converts rotation of the guide rail to displacement movement of the guide rail in the gap adjustment direction;

wherein the facing surfaces of opposing printer side-frames are defined as inside surfaces, and the surface of each printer side-frame opposite its respective inside surface is defined as an outside surface;

wherein the rotary transfer mechanism and the cam mechanism are disposed to one printer side-frame on its inside frame surface; and wherein the rotary transfer mechanism of the platen gap adjustment mechanism includes a carriage stop configured to contact and stop the head carriage when the head carriage moves past a specific position toward one of the printer side-frames.

13. The printer described in claim 12, wherein:

the rotary transfer mechanism includes:

a rotary shaft extending along the inside frame surface perpendicularly to the guide rail, a worm disposed coaxially to the rotary shaft, and a worm wheel disposed coaxially to a first end of the guide rail and meshing with the worm; and the cam mechanism includes:

a rotary cam attached to the first end of the guide rail and positioned between the worm wheel and the inside frame surface, and a cam follower disposed at a position on the inside frame surface where the cam follower continuously contacts the outside cam surface of the rotary cam at a contact point, wherein the outside cam surface is shaped so that the contact point moves along the gap adjustment direction with rotation of the rotary cam.

14. The printer described in claim 12, further comprising:

a media conveyance roller disposed between the printer side-frames and conveying a print medium along the print medium conveyance path; and a power transfer mechanism that transfers rotation from a rotary drive source to the media conveyance roller;

wherein the rotary transfer mechanism and the cam mechanism are disposed along the inside surface of one printer side-frame, and the power transfer mechanism is disposed along the outside surface of the printer side-frame opposing the one printer side-frame.

15. The printer described in claim 13, wherein:

the platen gap adjustment mechanism includes a stationary-side rotary shaft disposed at a fixed position along the gap adjustment direction; and a universal joint connecting the stationary-side rotary shaft to the rotary shaft.

* * * * *